US006702133B1

(12) United States Patent
Shenkar et al.

(10) Patent No.: US 6,702,133 B1
(45) Date of Patent: Mar. 9, 2004

(54) PLASTIC RETORABLE CONTAINER SYSTEM HAVING A CLOSURE WITH AN IMPROVED CONFORMABLE LINER

(75) Inventors: Emanuel Shenkar, Worth, IL (US); Donald Deubel, New Lenox, IL (US); Min Miles Wan, Plainfield, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/689,934

(22) Filed: Oct. 12, 2000

(51) Int. Cl.[7] ..... B65D 53/00

(52) U.S. Cl. ..... 215/249; 215/341; 215/351; 215/354; 215/252; 215/DIG. 1

(58) Field of Search ..... 215/349, 341, 215/344, 354, 329, 321, DIG. 1, 44, 45, 43, 350, 351, 252; 264/268; 270/780, 781, 782

(56) References Cited

U.S. PATENT DOCUMENTS

| | | | | | |
|---|---|---|---|---|---|
| 1,448,094 | A | * | 3/1923 | Sorgan | 215/321 |
| 1,972,280 | A | * | 4/1934 | Von Till | 215/351 |
| 3,428,208 | A | * | 2/1969 | Kosar | 215/341 |
| 3,482,725 | A | * | 12/1969 | Exton | 215/344 |
| 3,494,496 | A | * | 2/1970 | Livingstone | 215/344 |
| 3,536,224 | A | * | 10/1970 | Green | 215/344 |

(List continued on next page.)

FOREIGN PATENT DOCUMENTS

| | | | |
|---|---|---|---|
| EP | 0 447 021 | A2 | 8/1991 |
| EP | 0 560 051 | A1 | 9/1993 |
| EP | 0 616 951 | A1 | 9/1994 |
| EP | 0 801 005 | A1 | 11/1995 |
| JP | 7-257624 | * | 10/1995 |
| WO | WO 92/03378 | | 3/1992 |

U.S. PATENT DOCUMENTS

| | | | | | |
|---|---|---|---|---|---|
| 4,156,490 | A | | 5/1979 | Peraboni | |
| 4,196,818 | A | | 4/1980 | Brownbill | |
| 4,299,328 | A | | 11/1981 | Ochs et al. | |
| 4,418,828 | A | | 12/1983 | Wilde et al. | |
| 4,432,461 | A | | 2/1984 | Mumford et al. | |
| 4,458,822 | A | | 7/1984 | Ostrowsky | |
| 4,478,343 | A | | 10/1984 | Ostrowsky | |
| 4,506,795 | A | | 3/1985 | Herr | |
| 4,511,054 | A | | 4/1985 | Shank | |
| 4,512,493 | A | * | 4/1985 | Von Holdt | 220/780 |
| 4,526,282 | A | | 7/1985 | Dutt et al. | |
| 4,545,496 | A | | 10/1985 | Wilde et al. | |
| 4,546,892 | A | | 10/1985 | Couput | |

(List continued on next page.)

*Primary Examiner*—Robin A. Hylton
(74) *Attorney, Agent, or Firm*—Woodcock Washburn LLP

(57) ABSTRACT

A retortable all-plastic closure having a generally circular top portion and a generally cylindrical downwardly depending skirt. The top portion has upper and lower surfaces. The lower surface of the top portion forms a circumferentially extending ridge that projects downwardly. The ridge forms a first structural wall. A second structural wall is formed in the top portion adjacent the first wall. A flexible liner made from a thermoplastic elastomer is bonded to the lower surface. The portion of the liner covering the first structural wall forms a downwardly extending liner wall. The portion of the liner covering the second structural wall forms a top liner wall. The diameter of the downwardly extending liner wall is greater than the diameter of the top of the container neck inner wall to which the closure is applied so that the container neck compresses substantially the entirety of the downwardly projecting liner wall. In addition, the diameter of top liner wall is greater than the uppermost portion of the container neck so that the top liner wall is also compressed. Grooves are formed in the closure top portion opposite the ridge so as to minimize the thickness gradient in the top portion. A network of ribs are formed in the grooves.

12 Claims, 5 Drawing Sheets

U.S. PATENT DOCUMENTS 4,550,844 A 11/1985 Lininger
4,592,475 A 6/1986 Hannon et al.
4,595,110 A 6/1986 Herr
4,657,153 A 4/1987 Hayes
4,694,969 A 9/1987 Granat
4,697,716 A * 10/1987 Mumford ..... 215/341
4,732,289 A 3/1988 Granat et al.
4,774,134 A 9/1988 Kehe et al.
4,796,770 A 1/1989 Begley
4,801,030 A 1/1989 Barriac
4,813,561 A 3/1989 Ochs
4,813,562 A 3/1989 Begley
4,848,614 A 7/1989 Csaszar
4,875,594 A 10/1989 Ochs
4,907,709 A * 3/1990 Abe et al. ..... 215/252
4,978,016 A 12/1990 Hayes
4,981,230 A 1/1991 Marshall et al.
4,991,731 A 2/1991 Osip et al.
5,004,110 A 4/1991 Osip et al.
5,020,683 A * 6/1991 Strassheimer ..... 215/354
5,054,268 A 10/1991 Hayes et al.
5,058,755 A 10/1991 Hayes
5,060,813 A * 10/1991 Gollasch et al. ..... 215/329
5,062,538 A 11/1991 Ochs
5,078,290 A * 1/1992 Ochs ..... 215/252
5,080,246 A 1/1992 Hayes
5,090,788 A 2/1992 Ingram et al.
5,204,181 A 4/1993 Suzuki et al.
5,341,949 A 8/1994 Hayes
5,346,082 A 9/1994 Ochs et al.
5,443,171 A 8/1995 Sprowl
5,660,290 A 8/1997 Hayes
5,677,053 A 10/1997 Moriga et al.
5,755,347 A 5/1998 Ingram
5,913,434 A 6/1999 Fukuhara et al.
5,947,311 A * 9/1999 Gregory ..... 215/252
6,202,871 B1 * 3/2001 Kelly ..... 215/350

* cited by examiner

PLASTIC RETORABLE CONTAINER SYSTEM HAVING A CLOSURE WITH AN IMPROVED CONFORMABLE LINER

FIELD OF THE INVENTION

The current invention is directed to a closure for a container. More specifically, the current invention is directed to a plastic closure having a seal adapted to withstand retorting.

BACKGROUND OF THE INVENTION

Certain beverages and food stuffs, for example, liquid pediatric nutritional products, must be sterilized after being hermetically sealed in the containers in which they will ultimately be sold. Sterilization is typically accomplished by a retorting process in which the container is heated to relatively high temperatures, such as 260° F. or above. Although steam is used to subject the container to external pressurization during retorting in order to reduce the effects of the increased internal pressure generated by the heating, there is nevertheless a pressure imbalance that imposes additional forces on the container and closure. Thus, the closures for such containers, which are typically referred to as "retortable closures," must be capable of maintaining a hermetic seal when subjected to the temperatures and pressures associated with retorting.

Although closures for many applications, such as carbonated beverages, are made entirely from plastic, in the past, closures for retortable containers were made from metal or, more recently, composites of metal and plastic, such as polypropylene. Such a composite retortable closure is disclosed in U.S. Pat. No. 4,813,561 (Ochs). In such closures, sealing between the closure and container neck is provided by a bead of sealant, such as plastisol, applied to the metallic portion of the closure. The use of metal in a retortable closure was thought necessary because the high temperatures associated with retorting weakens and distorts plastic. It was thought that unless metal was used to stiffen and stabilize the closure, especially the portion supporting the sealant, the high temperatures and pressure resulting from retorting would result in loss of the hermetic seal.

Consequently, it would be desirable to provide a retortable plastic closure with improved sealing capability.

SUMMARY OF THE INVENTION

It is an object of the current invention to provide a retortable plastic closure, especially an all-plastic retortable closure. This and other objects is accomplished in a retortable container system, comprising (i) a container having a neck portion forming an approximately cylindrical inner wall, the upper portion of the inner wall having a diameter $d_2$, (ii) a closure, the closure comprising (i) a generally circular plastic top portion having upper and lower surfaces, and (ii) a generally cylindrical plastic skirt portion extending downwardly from the top portion, the skirt portion having means for securing the closure to the container neck portion, (iii) a seal for sealing the closure to the container. The seal comprises a (i) circumferentially extending ridge integrally formed in the plastic top portion so as to project downwardly from the lower surface thereof, the ridge forming a first structural wall extending downwardly from the lower surface of the plastic top portion, and (ii) a flexible liner bonded to the lower surface of the plastic top portion, a first portion of the flexible liner covering at least the first structural wall so as to form a downwardly extending liner wall, the liner wall having a diameter that is greater than the diameter of the container neck inner wall upper portion, whereby the container neck inner wall compresses the liner wall when the closure is applied to the container.

DESCRIPTION OF THE PREFERRED EMBODIMENT

Figure 1:
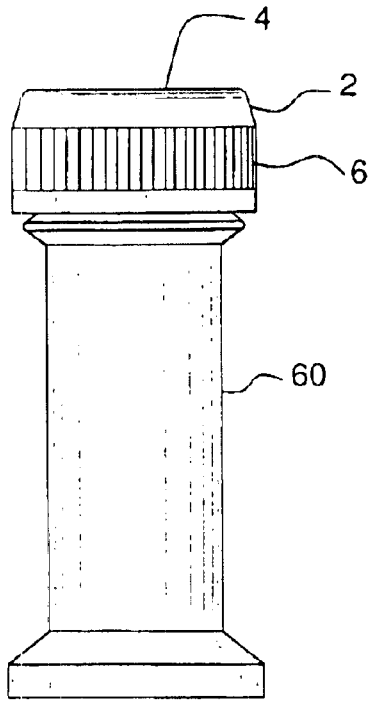
FIG. 1 is an elevation of a closure according to the current invention as applied to a conventional retortable plastic container.
Figure 2:
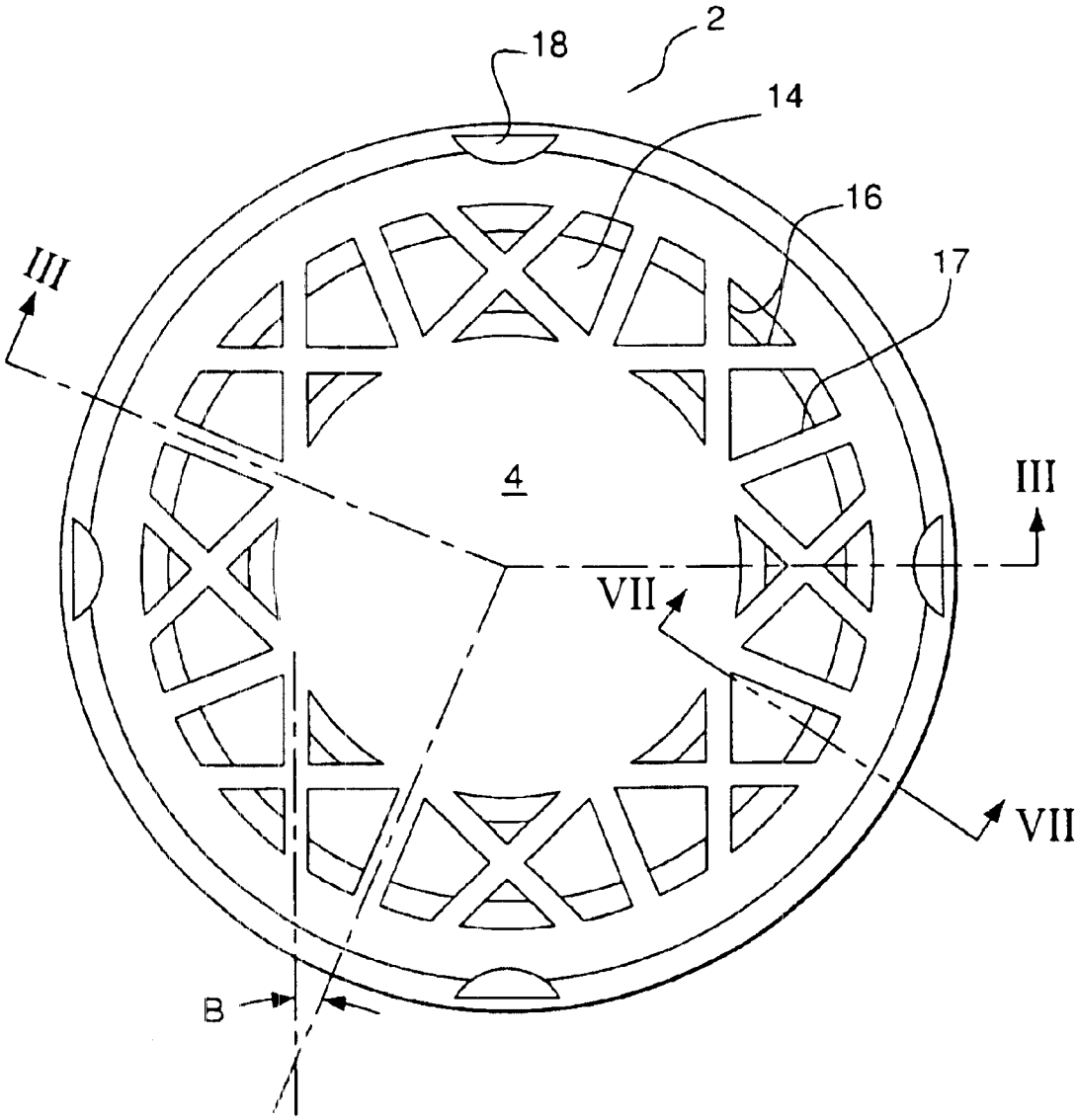
FIG. 2 is a plan view of the closure according to the current invention shown in FIG. 1.
Figure 3:
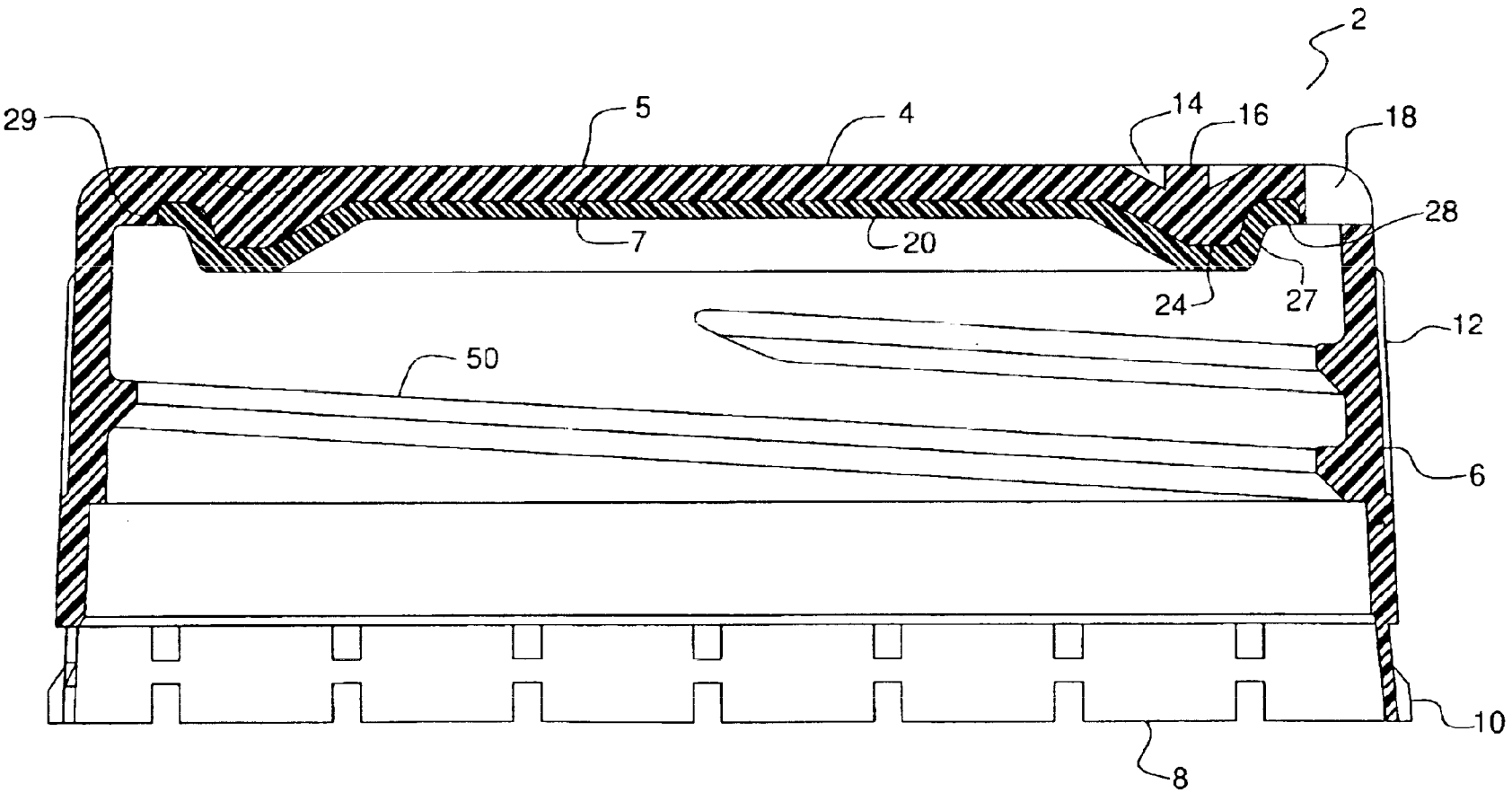
FIG. 3 is a cross-section taken along line III—III shown in FIG. 2.

A retortable plastic closure 2 according to the current invention is shown applied to a conventional retortable plastic container 60 in FIG. 1. As shown in FIGS. 2 and 3, the closure 2 is comprised of a circular plastic top portion 4, having upper and lower surfaces 5 and 7, respectively, and a cylindrical skirt 6 extending downwardly from the top portion and integrally formed with it. Axially extending ribs 12, which aid gripping of the closure, are circumferentially distributed around the skirt 6. As is conventional, a thread 50 is formed in the inner wall of the skirt portion 6 that mates with the thread 51 formed on the outer wall of the neck portion 40 of the conventional retortable container, shown in FIG. 6. Although threads are used in the preferred embodiment, those skilled in the art will recognize that other methods of securing the closure to the container may also be utilized, such as a snap-on configuration.

Figure 6:
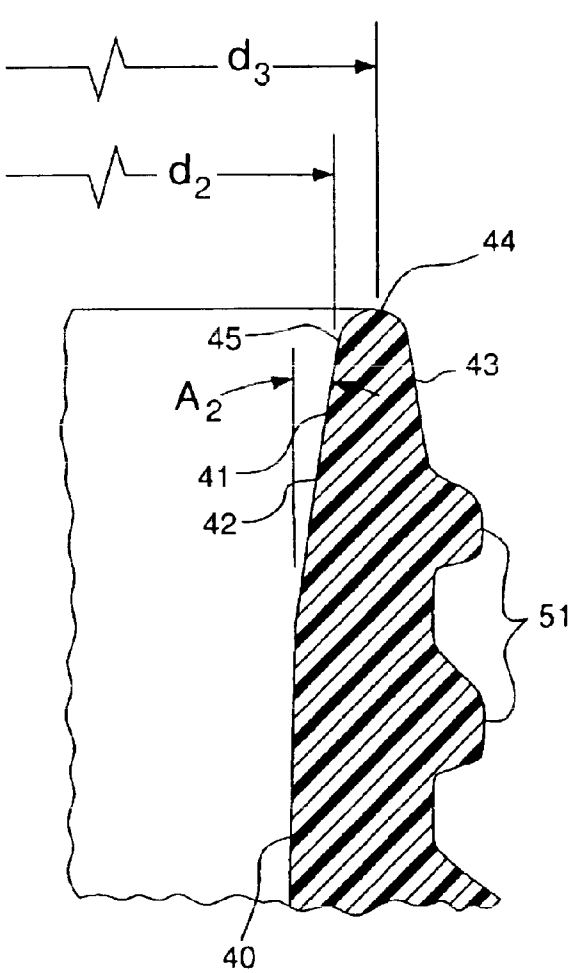
FIG. 6 (PRIOR ART)
FIG. 6 is a detailed view of a portion of a longitudinal cross-section through the neck portion of the container shown in FIG. 1.

As shown in FIG. 6, the neck 40 of the container 60 forms an approximately cylindrical inner wall 42 that is preferably slightly conical so as to be oriented at an angle $A_2$ to the container axis that, for example, may be about 8°, so that the neck inner wall tapers outwardly (i.e., become thicker) as it extends downwardly. The topmost portion 45 of the straight section of the inner wall 42 has a diameter $d_2$, while the uppermost portion 44 of the container neck 40 is formed by a convex segment, the top of which has a diameter $d_3$.

Although not necessary for the practice of the current invention, as is conventional, a tamper evident band 10 may be formed on the lower portion of the skirt 6 and may include ratchet teeth that engage mating ratchet teeth formed in the container neck, such as disclosed in the aforementioned U.S. Pat. No. 4,813,561, hereby incorporated by reference herein.

Preferably, the top portion 4, skirt 6, and tamper evident band 10 are integrally formed by injection molding a plastic, such as polypropylene. The polypropylene is of a grade having a sufficiently high heat distortion temperature, typically referred to as HDT, so as to be able to withstand retorting, such as SV 954 grade polypropylene available from Montell U.S.A. Inc. of Wilmington, Del. In the preferred embodiment, the closure is made entirely of plastic and no metal is used to strengthen the top portion 4 or skirt 6.

A number of half-moon shaped openings 18 are formed in the periphery of the top portion 4. The openings 18 allow the threaded portions of the closure and container neck to be washed after the closure 2 has been secured to the container, for example, to remove fluid that spilled onto the threaded portions during filling and capping.

According to one important aspect of the current invention, a circumferentially extending ridge 24 is integrally formed in the lower surface 7 of the top portion 4. The ridge 24 serves to resist radially inward pressure resulting from compression of a liner 20 by the container neck, as discussed below. Preferably, the ridge 24 projects downwardly from the adjacent portions of the lower surface 7 by at least about 0.075 inch (1.9 mm).

Figure 5:
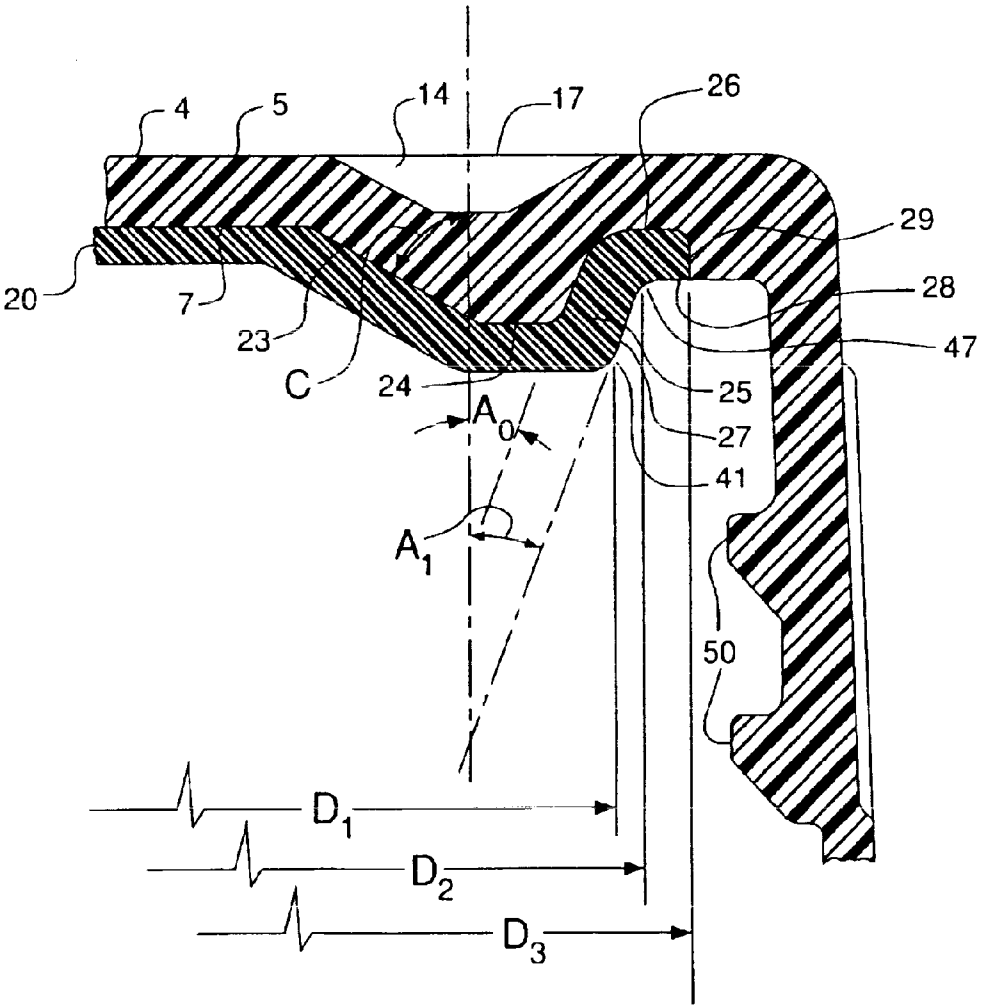
FIG. 5 is a detailed view of a portion of a cross-section of the closure shown in FIGS. 2 and 3.

As shown best in FIG. 5, the inner surface of the ridge 24 forms a circumferentially extending wall 23 that is oriented at an angle C to the axis of the closure 2 that is at least about 45°, and preferably about 60°. The angling of the wall 23 allows the liner material to flow over the lower surface 7 during compression molding, as discussed below. The outer surface of the ridge 24 forms a circumferentially extending structural wall 25 that is preferably disposed an at angle $A_0$ to the axis of the closure 2 so that the wall tapers inwardly as it extends downwardly. Preferably, the angle $A_0$ is at least about 5° but not more than about 15° greater than the angle $A_2$ of the container neck inner wall 42. Most preferably, $A_0$ is about 7° greater than $A_2$. In one embodiment of the invention, the angle $A_0$ is approximately 15° and the angle $A_2$ is about 8°. A circumferentially extending structural wall 26 is also integrally formed in the lower surface 7 disposed adjacent the ridge wall 25. Preferably, the wall 26 is oriented approximately radially. Finally, an axially oriented, circumferentially extending structural wall 29 is formed adjacent the wall 26.

If no additional modifications are made to the design, the presence of the ridge 24 would increase the difference between the thick and thin portions of the top portion 4. In one particular embodiment of the invention, the thickness of the central panel portion of the top portion 4 is about 0.06 inch (1.5 mm) and the ridge 24 projects downwardly about 0.077 inch (2.0 mm). This would result in a thickness in the ridge area of approximately 0.137 inch (3.5 mm) so that the ratio of the maximum to minimum thickness of the top portion was almost 2.3. Such a nonuniform thickness profile can result in temperature gradients that cause distortion of the closure 2 as it cools following injection molding, creating sink marks.

Therefore, in a preferred embodiment of the invention, a circumferentially extending groove 14 is formed in the upper surface 5 of the top portion 4 opposite the ridge 24 so that the distance between the bottom of the groove and the surface of the ridge defines the thickness of the top portion in the vicinity of the ridge, thereby resulting in a more uniform thickness throughout the top portion. For example, in the particular embodiment discussed above, the depth of the groove 14 is about 0.047 inch, so that the thickness of the top portion 4 in the vicinity of the ridge 24 is only 0.090 inch (2.29 mm). This reduces the maximum to minimum thickness ratio in the top portion 4 to about 1.5 and prevents distortion of the closure 2 following injection molding.

Figure 4:
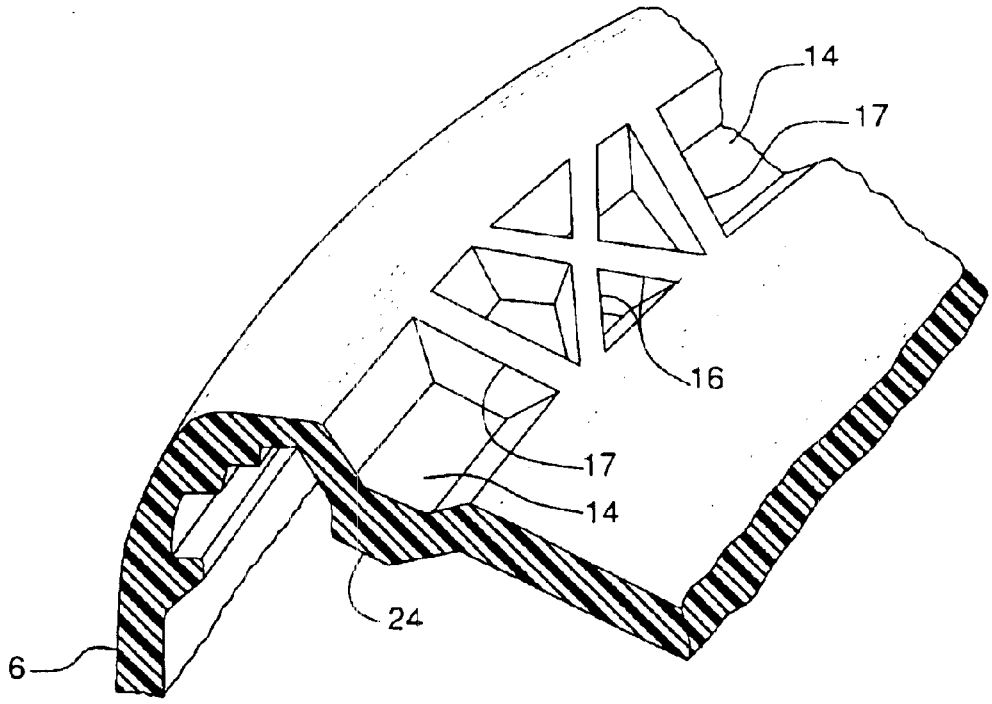
FIG. 4 is an isometric view of a portion of a cross-section of a closure according to the current invention showing the stiffening ribs.

Unfortunately, the presence of the groove 14 can also reduce the strength of the closure 2, especially in light of the presence of the washing openings 18 nearby. Thus, in a preferred embodiment of the invention, a network of ribs 16 and 17 are integrally formed within the groove 14, as shown best in FIGS. 2 and 4. Preferably a first portion 17 of the ribs are distributed around the circumference of the groove 14 at 45° intervals and extend in the approximately radial direction. A second portion 16 of the ribs extend at an angle B to the radial direction so as to form crosses. Preferably, the angle B is about 20° to 30°.

According to the invention, a flexible sealing liner 20 is attached to the lower surface 7 of the top portion 4. The liner 20 is made from a flexible plastic material, preferably a conventional thermoplastic elastomer, such as Kraton™, developed by Shell Chemical Company and available from GLS Corporation's Thermoplastic Elastomers Division. Most preferably, the liner 20 is a thermoplastic elastomer with oxygen barrier properties, such as Trefsin™, available from Advanced Polymer Systems LP of Akron, Ohio, or Polyliner™, available from D.S. Chemie of Germany.

Preferably, the liner 20 is formed by extruding a bead of thermoplastic elastomer onto the center of the top portion lower surface 7 and then compression molding it so as to form a liner bonded to the portion of the lower surface 7 encompassed by the axially extending wall 29. Preferably, the liner 20 is compression molded so as to have a thickness of about 0.030 inches (0.76 mm) in the central portion of the lower surface 7 and about 0.040 inches (1 mm) in the vicinity of the ridge 24—that is, the portion of the liner 20 covering the ridge 24 should be about ⅓ thicker than the central portion of the liner in order to minimize the amount of liner material utilized. Although additional increases in the thickness differential by further thinning of the central portion of the liner 20 would reduce material usage even more, it may require the application of excessively large pressures by the punch during compression molding and, therefore, is preferably avoided.

As shown best in FIG. 5, the liner 20 covers the entirety of the ridge 24 formed in the lower surface 7, including the inner ridge wall 23 and the outer ridge wall 25. The portion of the liner 20 covering the inner ridge wall 23 forms a downwardly extending liner inner wall. The portion of the liner 20 covering the outer ridge wall 25 forms a circumferentially extending and downwardly projecting outer liner wall 27. Preferably, the length of the downwardly projecting wall is at least about 0.075 inch (1.9 mm) long. Preferably, the downwardly projecting liner wall 27 is oriented at an angle $A_1$ that approximately matches the angle $A_0$ of the structural wall so that the liner wall tapers inwardly as it extends downwardly to a lowermost portion 41. Thus, the angle $A_1$ to is greater than the angle $A_2$ of the container neck wall 42, preferably by at least about 5° and more preferably by at least about 7° but not more than about 15°. In addition, the diameter $D_2$ of the uppermost portion 47 of the downwardly projecting liner wall 27 is greater than the diameter $d_2$ of the upper portion of the container neck wall 42.

Since the diameter $D_2$ of the upper liner wall is greater than the diameter $d_2$ of the upper neck wall, as the closure 2 is threaded onto the container neck 40, the upper portion 47 of the liner wall 27 will initially make line contact with the neck wall 42. Under the action of the threads, further rotation of the closure 2 drives it downward onto the container neck 40. This causes the liner 20 to compress so that the upper surface 47 of the liner wall 27 conforms to the upper portion of the neck inner wall, resulting in surface contact between the liner wall 27 and the container neck inner wall 42 at the upper portion of the liner wall. As the closure 2 is tightened further onto the container neck 40, the surface of the liner wall 27 conforming to the neck outer wall 42 spreads downward so that middle surface of the liner wall then conforms to the neck wall. Preferably, this is followed by the lower portion 41 conforming to the container neck inner wall 42 when the closure 2 is fully tightened onto the container neck. Thus, the diameter $D_2$ is sufficiently greater than $d_2$ so that, despite the fact that $A_1$ is greater than $A_2$, the compression of the liner 20 will eventually cause a major portion, and most preferably the entirety, of the downwardly projecting liner wall 27 to conform to the surface of the neck outer wall 42. Preferably, the diameter $D_2$ of the top of the liner wall 27 is at least about 0.010 inches (0.25 mm) greater than the diameter $d_2$ at the top of the container neck wall. In one embodiment of the invention, $D_2$ is about 0.014 inch (0.36 mm) greater than $d_2$.

Causing the compression of the liner 20 to spread downward as described above causes the majority of elastic deformation or flow of the liner to occur downwardly, thereby maximizing the compression of the liner that results from a given magnitude of torque applied to the closure 2—that is, the amount of compression that is ultimately achieved is greater than it would have been if the initial contact had been along the entire surface of the liner wall 27 so that further compression required the liner to flow elastically not only downwardly, but upwardly, where there is greater resistance to such elastic flow.

As also shown in FIG. 5, the portion of the liner 20 covering the radially extending wall 26, which is adjacent the downwardly extending liner wall 27, forms a radially extending upper liner wall 28. Since the liner 20 preferably extends to the axial wall 29 of the top portion, the diameter of the periphery of liner wall 28 is also $D_3$. Preferably, $D_3$ is greater than the diameter $d_3$ of the top of the uppermost portion 44 of the container neck 40 so as to ensure that a major portion, and preferably, substantially the entirety, of the upper liner wall 28 is compressed by, and conforms to, the surface of the uppermost portion 44 of the container neck 40 when the closure is threaded onto the neck.

Figure 7:
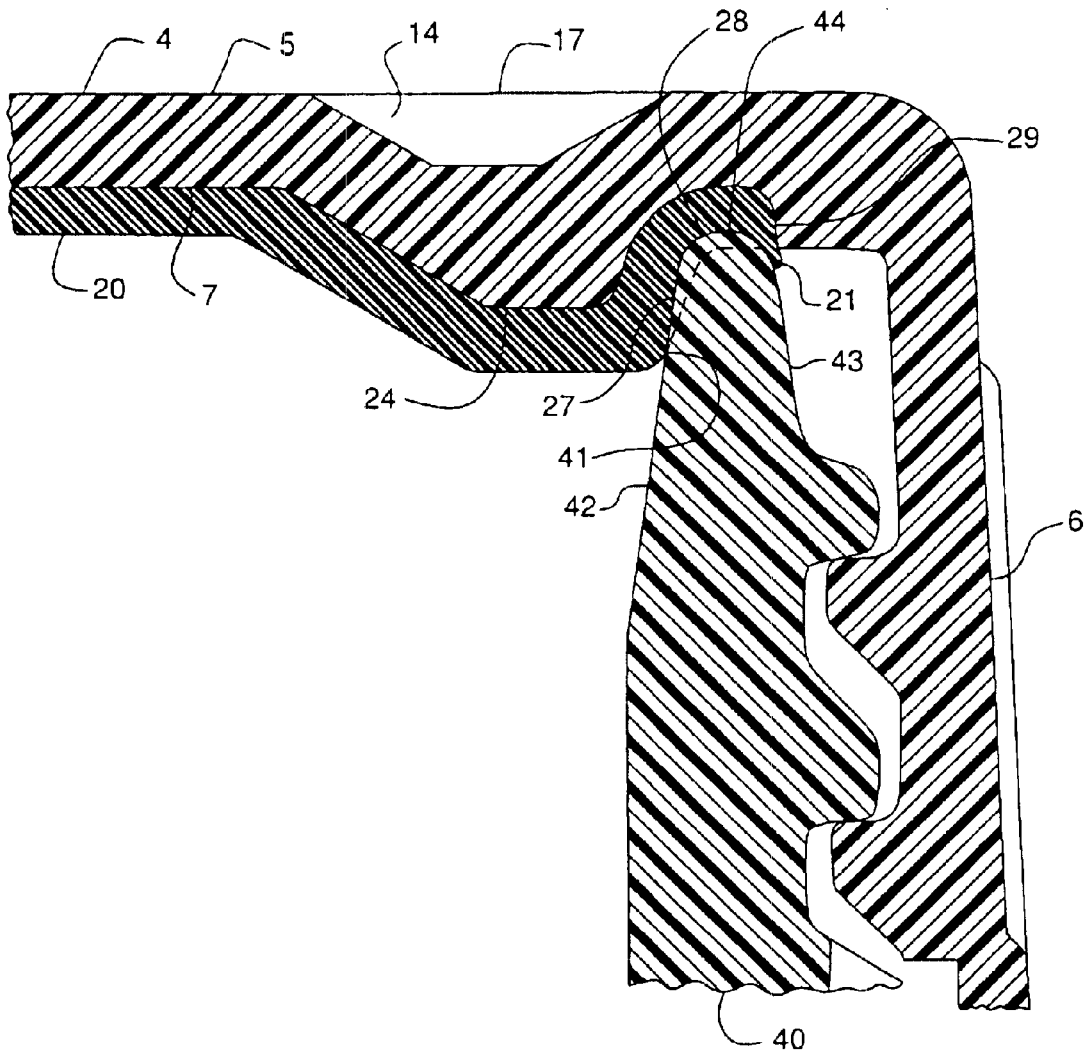
FIG. 7 is a detailed view of a cross-section of the closure shown in FIGS. 2 and 3 after installation on a container.

As shown in FIG. 7, preferably, when the closure 2 of the current invention is threaded onto the container neck 40, substantially the entirety of the liner downwardly projecting wall 27 is compressed radially inward by the upper portion of the neck inner wall 42. In addition, substantially the entirety of the liner upper wall 28 is compressed axially upward by the uppermost portion 44 of the container neck 40. (Note that the uncompressed location of the liner walls 27 and 28 is shown by the dashed line in FIG. 7.) This compression ensures that flexible liner 20 creates sealing contact over a large surface so as to provide a robust hermetic seal between the closure 2 and the container neck 40. The compression also causes a portion 21 of the liner 20 to extrude outward through the gap formed between the upper portion of the container neck outer wall 43 and the closure axial wall 29, as also shown in FIG. 7. This provides further sealing contact between the container neck 42 and the closure 2. Thus, a seal is provided not only along the uppermost portion 44 of the container neck 40 but also along the upper portion of its outer wall 43.

As a result of the extensive and robust sealing discussed above, and despite the fact that the closure 2 is preferably made entirely of plastic and is, therefore, subject to distortion and weakening during retorting, retorting will not result in a failure of the hermetic seal. Rather, such distortion will be accommodated by variation in the compression to which the liner 20 is subjected along both its downwardly projecting wall 27 and its upper wall 28.

Although the present invention has been illustrated in a system in which an outward facing liner wall contacts and conforms to the inner container neck wall, the invention could also be practiced by arranging the ridge on a larger diameter so that the inner facing liner wall contacted and conformed to the outer wall of the container neck. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A retortable container system, comprising:

a) a container having a neck portion forming an inner wall tapering radially outwardly as it extends upwardly so as to be inclined at an angle ($A_2$) to the axial direction, said wall having an upper portion having a diameter ($d_2$);

b) a closure, said closure comprising (i) a generally circular plastic top portion having upper and lower surfaces, and (ii) a generally cylindrical plastic skirt portion extending downwardly from said top portion, said skirt portion having means for securing said closure to said container neck portion;

c) a seal for sealing said closure to said container, said seal comprising (i) a circumferentially extending ridge integrally formed in said plastic top portion so as to project downwardly from said lower surface thereof, said ridge forming a first structural wall extending downwardly from said lower surface of said plastic top portion and tapering radially inwardly as it extends downwardly so as to be inclined to the axial direction, and (ii) a flexible liner bonded to said lower surface of said plastic top portion for compression by said container neck inner wall, a first portion of said flexible liner covering at least said first structural wall so as to form a downwardly extending liner wall having an outer diameter ($D_2$) and tapering radially inwardly as it extends downwardly so as to be inclined at an angle ($A_1$) to the axial direction, prior to compression of said liner by said container neck said liner wall angle ($A_1$) being sufficiently greater than said neck inner wall angle ($A_2$) and said liner wall outer diameter ($D_2$) being sufficiently greater than said diameter ($d_2$) of said container neck wall so that said container neck wall initially contacts said liner wall at said uppermost portion thereof and compression of said liner wall as said closure is tightened onto said container proceeds progressively downward.

2. The container system according to claim 1, whereby said diameter ($D_2$) of said liner wall upper portion is sufficiently greater than said diameter ($d_2$) of said container neck wall so that substantially the entirety of said liner wall is compressed by and conforms to said container neck wall when said closure is applied to said container.

3. The container system according to claim 1, wherein said seal further comprises an approximately circumferentially extending second structural wall integrally formed in said plastic top portion adjacent said first structural wall, a second portion of said flexible liner covering at least a portion of said second structural wall so as to form a second liner wall, whereby an uppermost portion of said container neck compresses said second liner wall when said closure is applied to said container.

4. The container system according to claim 3, wherein said seal further comprises an approximately circumferentially extending third structural wall integrally formed in said plastic top portion adjacent said second structural wall and disposed radially outward therefrom, said liner extending radially outward from said first structural wall to said third structural wall.

5. The container system according to claim 1, wherein said plastic top portion forms a circumferentially extending groove in said upper surface thereof, said groove disposed opposite said ridge, whereby the distance between said groove and said ridge define a thickness of said plastic top portion.

6. The container system according to claim 5, wherein said plastic top portion forms a plurality of ribs disposed in said groove.

7. The container system according to claim 6, wherein a first portion of said ribs extend in a first direction and a second portion of said ribs extend in a second direction so as to form a network of ribs.

8. The container system according to claim 1, wherein said angle ($A_2$) is about 8°.

9. The container system according to claim 1, wherein said liner wall angle ($A_1$) is at least about 5° greater than said container neck wall angle ($A_2$).

10. The container system according to claim 1, wherein said liner is formed from a thermoplastic elastomer.

11. A retortable container system, comprising:

a) a container having a neck portion forming an inner wall tapering radially outwardly as it extends upwardly so as to be inclined at an angle ($A_2$) to the axial direction, said wall having an upper portion;

b) a closure, said closure comprising (i) a generally circular plastic top portion having upper and lower surfaces, (ii) a generally cylindrical plastic skirt portion extending downwardly from said top portion, and (iii) a circumferentially extending ridge integrally formed in said plastic top portion so as to project downwardly from said lower surface thereof, said ridge forming a first structural wall extending downwardly from said lower surface of said plastic top portion;

c) a flexible liner bonded to said lower surface of said plastic top portion of said closure, a first portion of said flexible liner covering at least said first structural wall so as to form a downwardly extending liner wall having an outer diameter ($D_2$) and tapering radially inwardly as it extends downwardly so as to be inclined at an angle ($A_1$) to the axial direction;

d) means for causing said liner wall to progressively conform to said container neck wall along a surface of said liner having upper, middle and lower portions when said closure is applied to said container neck, whereby said liner wall conforming means causes said liner wall to conform to said neck wall along said upper portion of said liner surface first, followed by said middle portion of said liner surface, followed by said lower portion of said liner surface so that said conformance of said liner wall to said neck wall proceeds progressively from said first upper portion to said lower portion of said liner surface.

12. A retortable container system, comprising:

a) a container having a neck portion forming an inner wall tapering radially outwardly as it extends upwardly so as to be inclined at an angle ($A_2$) to the axial direction, said wall having an upper portion;

b) a closure, said closure comprising (i) a generally circular plastic top portion having upper and lower surfaces, (ii) a generally cylindrical plastic skirt portion extending downwardly from said top portion, and (iii) a circumferentially extending ridge integrally formed in said plastic top portion so as to project downwardly from said lower surface thereof, said ridge forming a first structural wall extending downwardly from said lower surface of said plastic top portion;

c) a flexible liner bonded to said lower surface of said plastic top portion of said closure, a first portion of said flexible liner covering at least said first structural wall so as to form a downwardly extending liner wall having an outer diameter ($D_2$) and tapering radially inwardly as it extends downwardly so as to be inclined at an angle ($A_1$) to the axial direction;

d) said liner wall angle ($A_1$) being greater than said neck inner wall angle ($A_2$) prior to conformance of said liner to said neck wall, thereby causing said liner wall to progressively conform to said container neck wall along a surface of said liner having upper, middle and lower portions when said closure is applied to said container neck and causing said liner wall to conform to said neck wall along said upper portion of said liner surface first, followed by said middle portion of said liner surface, followed by said lower portion of said liner surface so that said conformance of said liner wall to said neck wall proceeds progressively from said first upper portion to said lower portion of said liner surface.

* * * * *